US008054204B2

(12) United States Patent
Mattei et al.

(10) Patent No.: US 8,054,204 B2
(45) Date of Patent: Nov. 8, 2011

(54) METHOD FOR REMOTELY UPDATING WIRELESS SENSORS

(75) Inventors: David M. Mattei, Bolton, CT (US); William H. Beacham, Jr., Enfield, CT (US); Paul Raymond Scheid, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 410 days.

(21) Appl. No.: 12/474,895

(22) Filed: May 29, 2009

(65) Prior Publication Data

US 2010/0302071 A1 Dec. 2, 2010

(51) Int. Cl.
*G08B 21/00* (2006.01)

(52) U.S. Cl. ..... 340/945

(58) Field of Classification Search ..... 340/945, 340/449, 539.1, 517; 701/3; 455/98
See application file for complete search history.

(56) References Cited

U.S. PATENT DOCUMENTS

| | | | | |
|---|---|---|---|---|
| 6,154,636 | A | 11/2000 | Wright et al. | |
| 6,160,998 | A | 12/2000 | Wright et al. | |
| 6,173,159 | B1 | 1/2001 | Wright et al. | |
| 6,173,459 | B1 * | 1/2001 | Ball | 4/680 |
| 6,943,699 | B2 | 9/2005 | Ziarno | |
| 7,167,788 | B2 * | 1/2007 | Loda et al. | 701/100 |
| 7,246,003 | B2 | 7/2007 | Loda et al. | |
| 7,251,554 | B2 | 7/2007 | Loda et al. | |
| 2003/0085818 | A1 * | 5/2003 | Renton et al. | 340/945 |
| 2005/0026609 | A1 | 2/2005 | Brinkley et al. | |
| 2005/0027826 | A1 * | 2/2005 | Loda et al. | 709/219 |
| 2006/0057974 | A1 | 3/2006 | Ziarno et al. | |
| 2009/0030563 | A1 | 1/2009 | Beacham, Jr. | |

* cited by examiner

*Primary Examiner* — Phung Nguyen

(74) *Attorney, Agent, or Firm* — O'Shea Getz P.C.

(57) ABSTRACT

A method and system is provided for updating a sensor disposed within a mobile unit. The method includes the steps of: a) providing a remote server and at least one sensor, which remote server and sensor are located in the mobile unit and are in communications with one another through a first wireless network, and wherein the sensor has a first functionality; b) receiving an update signal transmitted from a base server to the remote server over a second wireless network; c) transmitting the received update signal from the remote server to the sensor over the first wireless network; and d) reconfiguring the sensor from the first functionality to a second functionality based upon the transmitted update signal.

20 Claims, 2 Drawing Sheets

METHOD FOR REMOTELY UPDATING WIRELESS SENSORS

BACKGROUND OF THE INVENTION

1. Technical Field

This disclosure relates generally to updating sensors and, more particularly to methods for remotely updating wireless sensors within a mobile unit.

2. Background Information

Typically, modern aircraft have sensor systems that include a plurality of wired or wireless sensors routinely used during operation. The sensors often require routine and/or frequent software updates to meet relevant requirements, to correct problems, and/or to increase the performance of the sensors. Generally, there are two prior art methods utilized to update the software in the sensors. First, each sensor or a part of each sensor (e.g., a memory) may be physically replaced. Second, the sensors may be physically connected via hard wire to an update module configured to load updated software into the sensors. However, these methods require physical interaction with the aircraft. As a result, the sensors generally may only be updated when the aircraft is grounded and being serviced.

What is needed is a method for updating one or more sensors disposed within a mobile unit, such as an aircraft, that overcomes the problems and shortcomings of the prior art.

SUMMARY OF THE DISCLOSURE

According to an aspect of the present disclosure, a method is provided for updating a sensor disposed within a mobile unit. The method includes the steps of: a) providing a remote server and at least one sensor, which remote server and sensor are located in the mobile unit and are in communications with one another through a first wireless network, and wherein the sensor has a first functionality; b) receiving an update signal transmitted from a base server to the remote server over a second wireless network; c) transmitting the received update signal from the remote server to the sensor over the first wireless network; and d) reconfiguring the sensor from the first functionality to a second functionality based upon the transmitted update signal.

According to another aspect of the present disclosure, a system for updating one or more sensors disposed within a mobile unit is provided. The system includes a remote server, at least one sensor, a first wireless network, a base server, and a second wireless network. The remote server, sensor, and the first wireless network are located in the mobile unit. The sensor has a first functionality. The first wireless network is adapted to provide wireless communications between the remote server and the sensor. The base server is adapted to transmit an update signal to the remote server over the second wireless network. The remote server is adapted to receive the update signal, and is further adapted to transmit the update signal to the sensor over the first wireless network. The sensor is operable to reconfigure from the first functionality to a second functionality based upon the transmitted update signal.

These and other aspects and features of the disclosure will become more readily apparent upon reading the following detailed description of the invention and viewing the accompanying figure.

DETAILED DESCRIPTION OF THE INVENTION

Figure 1:
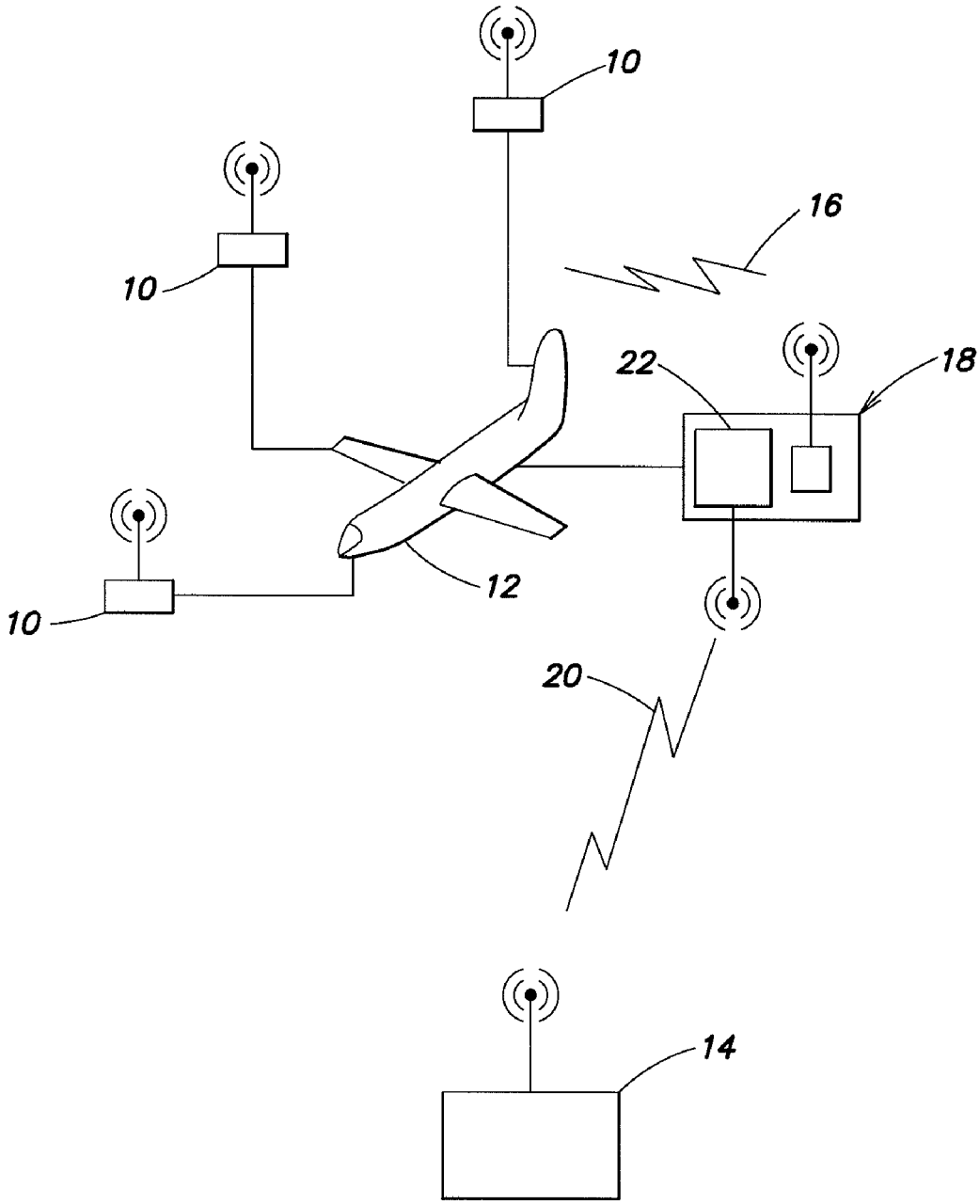
FIG. 1 is a schematic diagram of one embodiment of a system adapted to reconfigure one or more sensors from a first functionality to a second functionality.

Referring to FIG. 1, a method for updating one or more sensors 10 disposed within a mobile unit 12 is provided. The term "mobile unit" is used herein to describe a mobile vehicle such as an aircraft. The sensors 10 that can be updated using the present method include those that are adapted to receive an electronic signal from a wireless transmitter. The functionality of the sensor 10 will depend upon the application at hand, and can include sensors that are functionally operable to sense environmental parameter (e.g., temperature, pressure, humidity, etc.), sensors that are operable to sense actuator conditions, and the like. Actuator conditions may include mechanical-dynamic parameters (e.g., actuator position, travel, rate of movement, rate of change, operational state, etc.) and electrical parameters (e.g., voltage, current, strength of an electromagnetic fields, etc. into or out of the actuator). The ability of a sensor 10 to be "updated" refers to the ability of a sensor to change its functionality, for example, by being reprogrammed from a existing operational program to a new operational program, or by changing its operational output (e.g., changing the output from a pressure value to a temperature value), or by changing predetermined values (e.g., threshold values) used in the operation of the sensor, or by changing how the sensor interacts with a server and/or other sensors, etc. The present method is not limited to these types of functionalities, however.

The sensors 10 are in communication with a system that includes a base server 14, a first wireless network 16, a remote server 18, and a second wireless network 20. The base server 14 and the remote server 18 may include any suitable computer or processor known in the art. The specific configuration of each server will depend upon the application at hand and the present invention is not limited to any particular configuration. The first and second wireless networks 16, 20 may include any wireless communication network known in the art that is suitable to application at hand. The present method is not limited to any particular wireless communication system. The base server 14 is typically, but not necessarily, located in a stationary location (e.g., a building). The remote server 18 and the sensors 10 are disposed within, or attached to, the mobile unit 12. A gateway 22 is typically disposed between the sensors 10 and the remote server 18 to accommodate communications between each of the sensors 10 and the remote server 18. In those embodiments where the present invention is utilized in an avionics application, the mobile unit 12 is an aircraft and the remote server 18 can be utilized as an element within an avionics control system.

Figure 2:
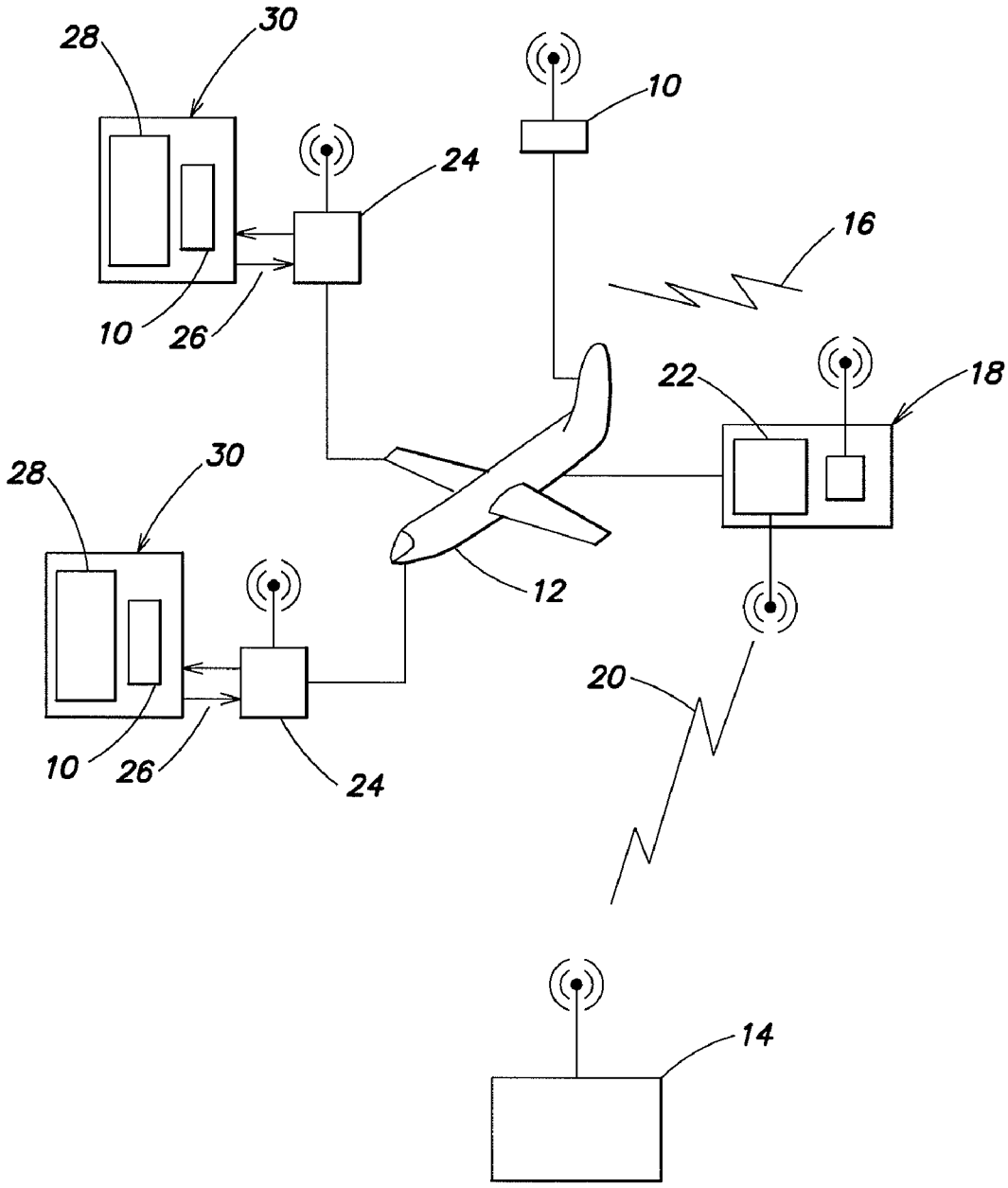
FIG. 2 is a schematic diagram of another embodiment of a system adapted to reconfigure one or more sensors from a first functionality to a second functionality.

In alternate embodiments as illustrated in FIG. 2, the sensors 10 are in communication with a system that includes the base server 14, the first wireless network 16, the remote server 18, the second wireless network 20, and one or more controllers 24 disposed within, or attached to, the mobile unit 12. In contrast to the system in FIG. 1, the sensors 10 and the controllers 24 are configured in one or more control/feedback loops 26 such that the controller 24 communicates with the remote server 18 via the first wireless network 16. In some embodiments, the sensors 10 are integrated with one or more actuators 28 in one or more sensor/actuator devices 30.

FIGS. 1 and 2 illustrate schematic diagram functionalities of two embodiments of the system. The base server 14 is adapted to transmit an update signal to the remote server 18 through the second wireless network 20. The update signal provides information (e.g., instructions, values, etc.) that will cause at least one of the sensors 10 to change from a first functionality to a second functionality. In the embodiment in FIG. 1, the remote server 18 is adapted to transmit the received update signal to the one or more sensors 10 through the first wireless network 16. In the embodiment of FIG. 2, the remote server 18 is adapted to transmit the received update signal to the one or more controllers through the first wireless network 16, and the one or more controllers are adapted to transmit (e.g., via a wired or a wireless connection or network) the received update signal to the one or more sensors 10.

In operation, the base server 14 is prompted, either manually or automatically, to transmit the update signal over the second wireless network 20, which signal is subsequently received by the remote server 18. An example of the methodology for transmitting and receiving a signal over a wireless network is disclosed in U.S. Pat. No. 7,167,788, which is hereby incorporated by reference in its entirety. The information basis for the update signals (e.g., maintenance, malfunction correction, performance enhancements, new functionality, etc.) can come from a variety of sources and can be prepared and sent via the base server by a dedicated service provider.

The remote server 18 communicates the received update signal to the gateway 22 through a wired or a wireless connection or network. The gateway 22 subsequently directly or indirectly (e.g. through the one or more controllers and/or other electrical components or devices) distributes the update signal to the appropriate one or more sensors 10. Upon receiving the update signal, the one or more sensors 10 are operable to automatically reconfigure from the first functionality to the second functionality; e.g., by overwriting or erasing data associated with the first functionality and loading data associated with the second functionality in sensor memory. For those sensors 10 that are designed as multi-functional sensors, the update signal may prompt a software change that changes the output of sensor from a first output (e.g., a temperature signal) to a second output (e.g., a humidity signal).

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A method for updating a sensor disposed within a mobile unit, comprising the steps of:

providing a remote server and at least one sensor, which remote server and sensor are located in the mobile unit and are in communications with one another through a first wireless network, and wherein the sensor has a first functionality;

receiving an update signal transmitted from a base server to the remote server over a second wireless network;

transmitting the received update signal from the remote server to the sensor over the first wireless network; and reconfiguring the sensor from the first functionality to a second functionality based upon the transmitted update signal.

2. The method of claim 1, wherein the mobile unit is an aircraft.

3. The method of claim 1, wherein the first functionality corresponds to a first environmental parameter and the second functionality corresponds to a second environmental parameter, wherein the first environmental parameter is different than the second environmental parameter.

4. The method of claim 3, wherein the first and the second environmental parameters are selected from a group consisting of temperature, pressure, and humidity.

5. The method of claim 1, wherein the first functionality corresponds to a first actuator condition, and the second functionality corresponds to a second actuator condition, wherein the first actuator condition is different than the second actuator condition.

6. The method of claim 5, wherein at least one of the first and the second actuator conditions is indicative of a mechanical-dynamic actuator parameter selected from a group consisting of position, travel, rate of movement, rate of change, and operational state.

7. The method of claim 5, wherein at least one of the first and the second actuator conditions is indicative of an electrical actuator parameter selected from a group consisting of voltage, current, and strength of an electromagnetic field.

8. The method of claim 1, wherein the first functionality corresponds to a first set of one or more predetermined values associated with sensor operation, and the second functionality corresponds to a second set of one or more predetermined values associated with sensor operation, wherein the first set of predetermined values is different than the second set of predetermined values.

9. The method of claim 8, wherein the first set of predetermined values is a first threshold value and the second set of predetermined values is a second threshold value.

10. A method for updating a sensor disposed within a mobile unit, comprising the steps of:

providing a remote server, at least one controller and at least one sensor, which remote server, controller and sensor are located in the mobile unit, which remote server and controller are in communications with one another through a first wireless network, and wherein the sensor has a first functionality and is in communication with the controller;

receiving an update signal transmitted from a base server to the remote server over a second wireless network;

transmitting the received update signal from the remote server to the controller over the first wireless network;

communicating the received update signal from the controller to the sensor; and reconfiguring the sensor from the first functionality to a second functionality based upon the transmitted update signal.

11. The method of claim 10, wherein the first functionality corresponds to a first environmental parameter and the second functionality corresponds to a second environmental parameter, wherein the first environmental parameter is different than the second environmental parameter.

12. The method of claim 11, wherein the first and the second environmental parameters are selected from a group consisting of temperature, pressure, and humidity.

13. The method of claim 10, wherein the first functionality corresponds to a first actuator condition, and the second functionality corresponds to a second actuator condition, wherein the first actuator condition is different than the second actuator condition.

14. The method of claim 13, wherein at least one of the first and the second actuator conditions is indicative of a mechanical-dynamic actuator parameter selected from a group consisting of position, travel, rate of movement, rate of change, and operational state.

15. The method of claim 13, wherein at least one of the first and the second actuator conditions is indicative of an electrical actuator parameter selected from a group consisting of voltage, current, and strength of an electromagnetic field.

16. The method of claim 10, wherein the first functionality corresponds to a first set of one or more predetermined values associated with sensor operation, and the second functionality corresponds to a second set of one or more predetermined values associated with sensor operation, wherein the first set of predetermined values is different than the second set of predetermined values.

17. The method of claim 16, wherein the first set of predetermined values is a first threshold value and the second set of predetermined values is a second threshold value.

18. The method of claim 10, wherein the sensor is integrated with an actuator.

19. A system for updating one or more sensors disposed within a mobile unit, comprising:

a remote server located in the mobile unit;

a sensor located in the mobile unit, which sensor has a first functionality;

a first wireless network located within the mobile unit, which first wireless network is adapted to provide wireless communications between the remote server and the sensor;

a base server adapted to transmit an update signal to the remote server over a second wireless network;

wherein the remote server is adapted to receive the update signal, and is further adapted to transmit the update signal to the sensor over the first wireless network; and wherein the sensor is operable to reconfigure from the first functionality to a second functionality based upon the transmitted update signal.

20. The system of claim 19, further comprising a controller in communication with the sensor and the remote server, wherein controller is adapted to receive the update signal from the remote server, and controller is adapted to transmit a signal representative of the update signal to the sensor.

* * * * *